US007140581B1

(12) United States Patent
White

(10) Patent No.: US 7,140,581 B1
(45) Date of Patent: Nov. 28, 2006

(54) PORTABLE STAND FOR SUPPORTING A SIGN

(76) Inventor: Linda White, 739 S. 22nd St., Banning, CA (US) 92220

( * ) Notice: Subject to any disclaimer, the term of this patent is extended or adjusted under 35 U.S.C. 154(b) by 68 days.

(21) Appl. No.: 11/071,858

(22) Filed: Mar. 3, 2005

Related U.S. Application Data

(60) Provisional application No. 60/550,222, filed on Mar. 4, 2004.

(51) Int. Cl.
*A47K 1/04* (2006.01)

(52) U.S. Cl. ..... 248/129; 40/606.02; 40/607.1; 248/910

(58) Field of Classification Search ..... 248/121, 248/129, 146, 151, 910; 40/606.02, 607.1, 40/612, 608, 607.13, 606.03, 606.18
See application file for complete search history.

(56) References Cited

U.S. PATENT DOCUMENTS 4,343,449 A * 8/1982 Osthus ..... 248/156
4,777,750 A * 10/1988 Garfinkle ..... 40/607.04
5,220,740 A 6/1993 Brault ..... 40/606
5,875,578 A 3/1999 Grewe ..... 40/608
5,878,518 A 3/1999 Grewe ..... 40/606
6,656,065 B1 * 12/2003 Nye ..... 473/481

* cited by examiner

*Primary Examiner*—Ramon O Ramirez
(74) *Attorney, Agent, or Firm*—Goldstein Law Offices, PC

(57) ABSTRACT

A portable stand for supporting one or more signs. The stand has a base, and a post extending vertically upward from the base. A pair of frames, having a cutout side, and a front window, attach securely to the post for holding the signs therein. The signs each insert into the frames along the cutout side of the frame, and are viewed through the front window of the frame. The base includes two sides, each having a recess that extends inwardly from the sides. A pair of wheels are secured within the recess for easily moving the stand. The base and the post each have a hollow inside cavity for temporarily holding water or sand therein for providing additional support and stability to the stand.

6 Claims, 3 Drawing Sheets

PORTABLE STAND FOR SUPPORTING A SIGN

CROSS REFERENCES AND RELATED SUBJECT MATTER

This application is a continuation of provisional patent application Ser. No. 60/550,222, filed in the United States Patent Office on Mar. 4, 2004.

BACKGROUND OF THE INVENTION

The invention relates to stands, and more particularly, to a portable stand for supporting a single or double-sided sign thereon.

Suburban neighborhoods are deluged with a variety of handmade signs on cardboard placards and posters, and are commonly secured to mailboxes and utility poles. Homemade signs are not always the most effective and practical way to advertise, and many communities have begun to restrict and even ban the use of homemade signs.

U.S. Pat. No. 5,220,740 to Brault discloses a moveable stand for supporting a sign. Having a base with wheels that are capable of being filled with water to provide weight. U.S. Pat. Nos. 5,875,578 and 5,878,518 both to Grewe disclose additional portable wheel signs suited to be filled with water.

While these units may be suitable for the particular purpose employed, or for general use, they would not be as suitable for the purposes of the present invention as disclosed hereafter.

SUMMARY OF THE INVENTION

It is an object of the invention to produce a stand for supporting a sign thereon, that can be weighted down for added stability. Accordingly, the portable stand of the invention includes a base and a post for supporting a sign. In addition, the post and base have a hollow cavity that can be filled with water or sand for providing the stand with additional stability.

It is another object of the invention to provide a stand for supporting a sign that is easily moveable. Accordingly, the base of the portable stand of the invention includes a pair of wheels attached within a recess along a side of the base for easily moving the stand from one location to another.

It is another object of the invention to provide a portable stand for supporting a sign, which can be easily stored and transported. Accordingly, the stand of the invention easily disassembles. The vertical post threads into an aperture within the base for assembly, and is unthreaded for disassembly by pushing on tabs attached to the base.

It is another object of the invention to provide a stand capable of being secured using a cable lock. Accordingly, the post of the stand of the invention includes a cylindrical hole therethrough for locking with a cable lock. In addition, the cylindrical hole, having two ends, has a pair of caps for plugging both ends of the hole when the cable lock is not in use.

The invention is a portable stand for supporting one or more signs. The stand has a base, and a post extending vertically upward from the base. A pair of frames, having a cutout side, and a front window, attach securely to the post for holding the signs therein. The signs each insert into the frames along the cutout side of the frame, and are viewed through the front window of the frame. The base includes two sides, each having a recess that extends inwardly from the sides. A pair of wheels are secured within the recess for easily moving the stand. The base and the post each have a hollow inside cavity for temporarily holding water or sand therein for providing additional support and stability to the stand.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
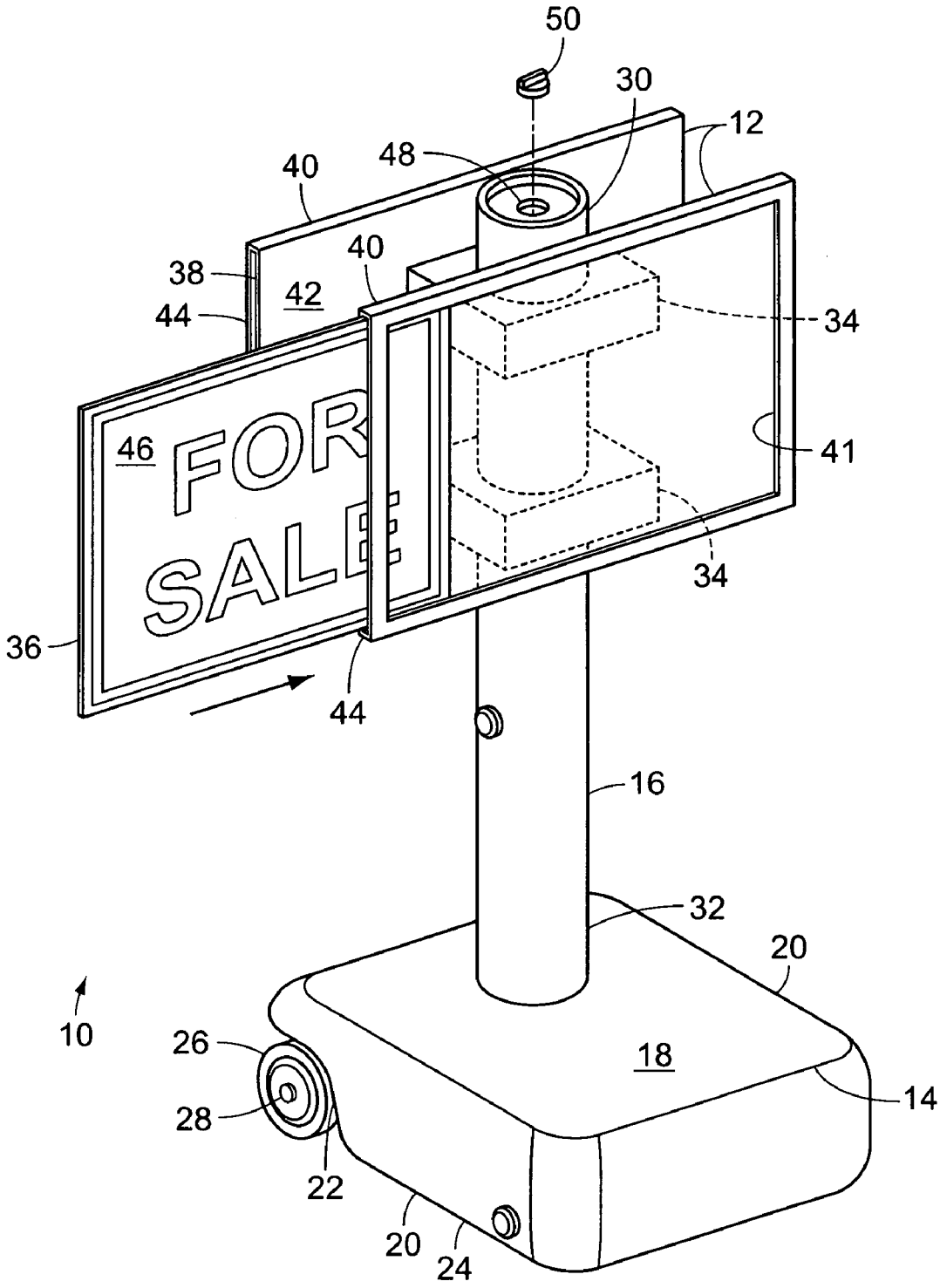
FIG. 1 is a diagrammatic perspective view of a portable stand of the present invention in use supporting a double-sided sign.

FIG. 1 illustrates a portable stand 10 of the present invention for supporting a single or double sign 12 thereon. The portable stand 10 includes a base 14 and a post 16. The base 14 has an upper surface 18 that includes an aperture adapted to vertically accept the post 16 intended to support the double signs 12.

The base 14 is made of a single weighted block that is preferably square or rectangular in contour and has a hollow inside cavity. The base 14 has a lower surface 24, which is intended to rest on a ground surface or floor. The base 14 has two sides 20, which each include a recess 22 that extends inwardly from the two sides 20 and upwardly from the lower surface 24, illustrated in FIG. 3. The base also includes a pair of wheels 26, which fit within the recess 22 of the base 14 and each attach to the base by an axle 28, which extends horizontally from the wheels 26 to the base 14. When the stand 10 is tilted backwardly and the weight is shifted onto the wheels 26 from the lower surface 24 of the base 14, the wheels 26 are able to easily move the stand 10 and double signs 12 from one location to another.

The post 16 having an upper end 30 and a lower end 32, is cylindrical in shape and has a hollow inside cavity. The post 16 includes a hole or opening 48 at the upper end 30. The opening 48 is sealed with a plug 50. The upper end 30 of the post 16 includes two square blocks 34 which attach to the double signs 12 of the stand 10. The double signs 12 include a removable front sign 36 and a removable rear sign 38 both attached on opposite sides of the post 16. Both signs 36 and 38 are reversible and are inserted into rectangular frames 40, which hold the removable signs 36 and 38 therein for displaying a message thereon through a front window 41 cutout therefrom. The frames 40 include a backing surface 42, which is permanently attached to the blocks 34 of the post 16. The frames 40 each have one vertical side 44, which is cutout for allowing the front and rear signs 36 and 38 to be inserted and replaced into the frames 40. The frames 40 can be made in all shapes and colors for accommodating different size signs 36 and 38. The removable signs 36 and 38 can be used to advertise messages including homes for sale, garage sales, detour directions, news flashes, sporting events, fundraisers, birthday parties, entrances and exits, lost items, grand openings, and personal messages. The removable front and rear signs 36 and 38 have a front surface 46 and a back surface, which can each include a different message.

Figure 2:
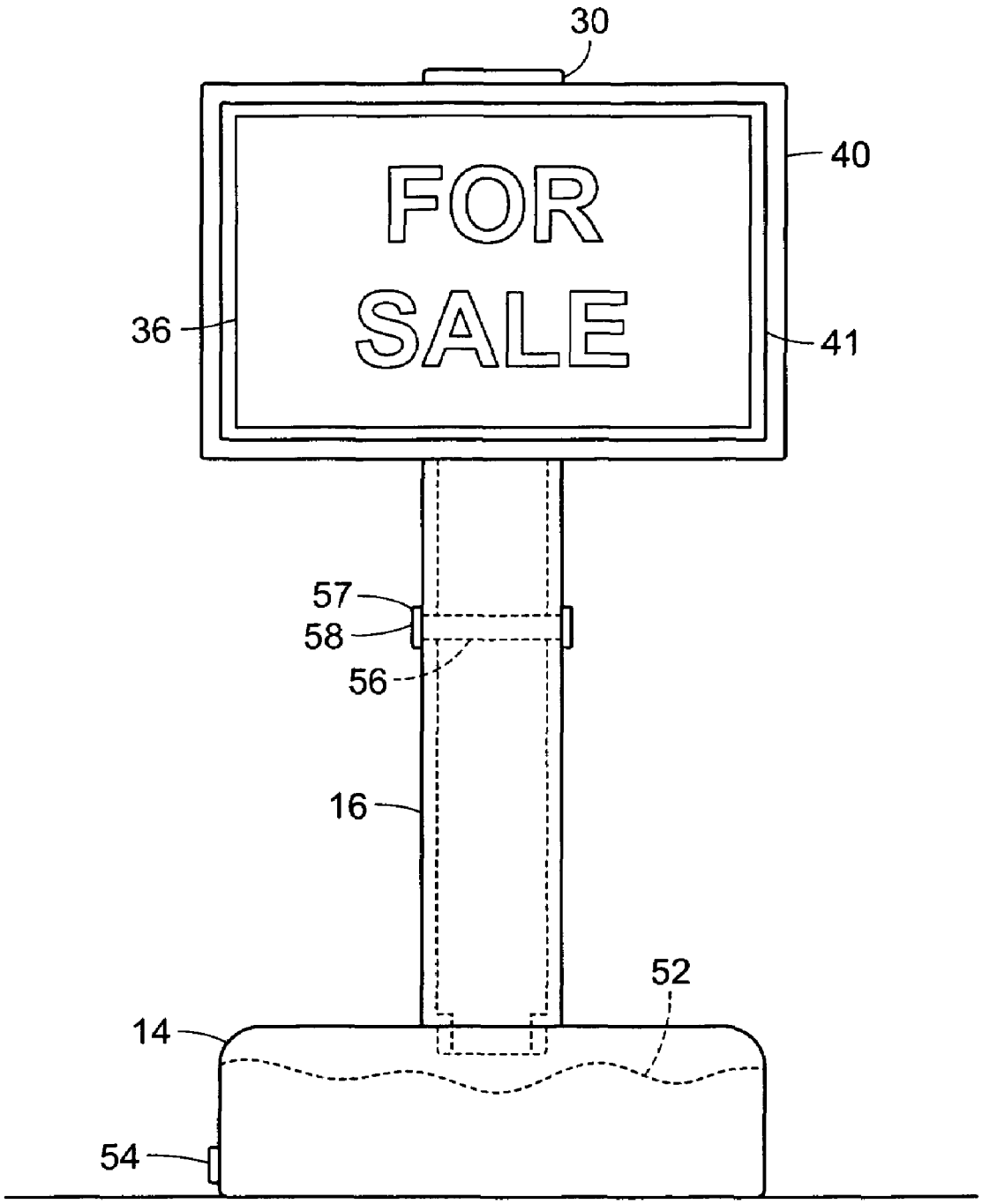
FIG. 2 is a front elevational view of the portable stand of the present invention, having a post attached to a base and showing the hollow cavity of the post and base, which are filled with water or sand to increase the stability of the stand.

FIG. 2 illustrates the front view of the stand 10 of the present invention including the post 16 and the base 14 for supporting the removable front sign 36. The removable front sign 36 is positioned within the frame 40 and visible through the front window 41 of the frame 40.

Once the stand 10 is positioned in place for viewing the sign 12, a user may fill the post 16 and base 14 with with a weighting substance such as water or sand 52 to prevent the stand 10 from moving or swaying by increasing stability. The water or sand 52 is inserted into the post 16 at the opening 48 at the upper end 30 of the post 16. Once the water or sand 52 fills-up the hollow inside cavity of the post 16 and base 14 the user may fasten the cap 50 onto the opening 30. This plugs the opening 30 to prevent spillage or debris from entering the hollow inside cavity of the post 16 and base 14. When the stand is ready to be moved, a side plug 54 in the base is removed and the water or sand 52 is allowed to drain outwardly from the post 16 and base 14. Once the water or sand 52 is competed drained from the post 16 and base 14, the side plug 54 of the base 14 can be replaced for safekeeping, and the stand 10 can easily be moved to another location or stored.

In addition, the post 16 includes a cylindrical hole 56, having two ends 57, which bisects the post 16 extending transversely, between the upper end 30 and the lower end 32. The cylindrical hole 56 is used for securing the stand 10 using a cable lock. When no cable lock is used a pair of caps 58 are used to plug each end 57 of the cylindrical hole 56 of the post 16.

Figure 3:
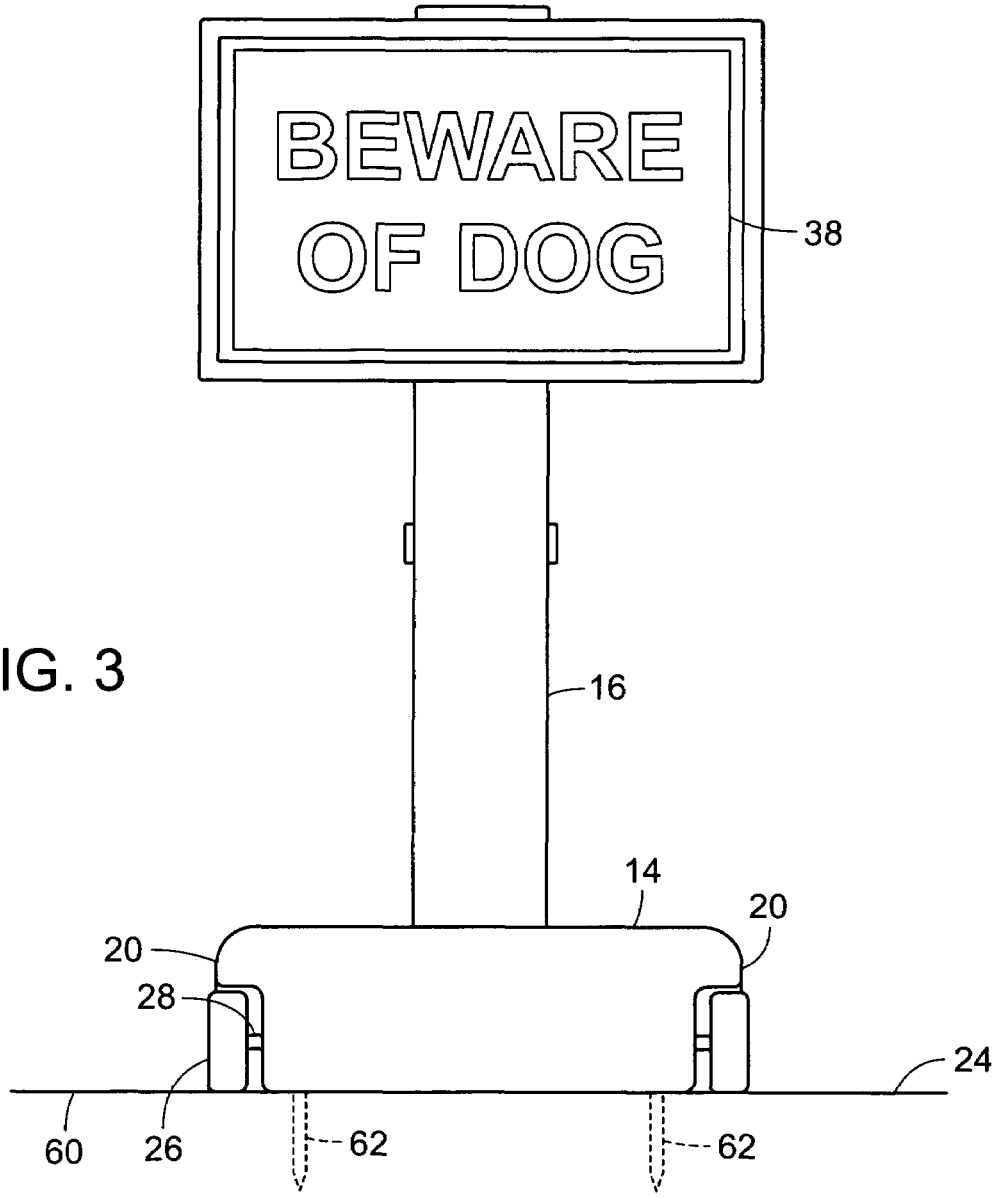
FIG. 3 is a rear elevational view of the portable stand of the present invention, having a pair of stakes attached to the base for securing the stand in the ground.

FIG. 3 illustrates a rear view of the stand 10 of the invention including the removable rear sign 38, the base 14 and the post 16. The lower surface 24 of the base 14 is resting against the ground surface 60. The wheels 26 are included on both sides 20 of the base 14, and are shown within the recesses 22 that extend upwardly from the lower surface 24 of the base 14 and inwardly from the sides 20 of the base 14. The axle 28 is shown extending inwardly from the wheels 26 to the base 14 at the recesses 22. In addition, a pair of stakes 62 are attached to the lower surface 24 of the base 14 and extend downwardly to penetrate below the ground surface 60 for holding the stand 10 securely in position and preventing the stand 10 from toppling over.

Figure 4:
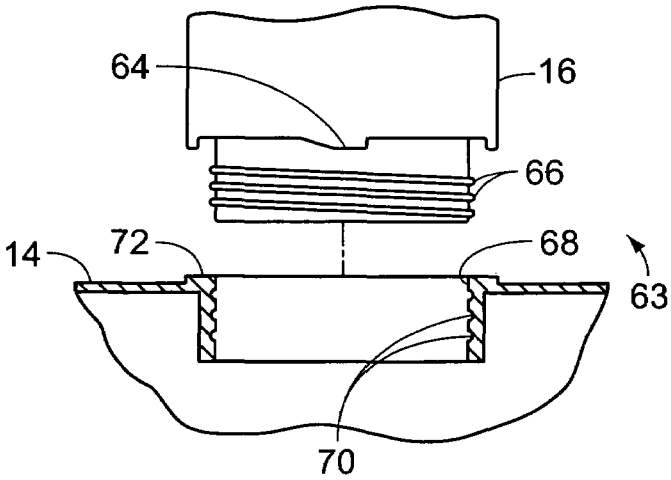
FIG. 4 is an exploded view of the screw connection between the post having external threads attached thereto, and the base having an aperture, having internal threads, for accepting the external threads of the post.

FIG. 4 illustrates an exploded view of a screw connection 63 attaching the post 16 to the base 14 of the present invention. The post 16 includes a tapered notch 64 and a plurality of external threads 66 for screwing into the aperture 68 of the base 14. The aperture 68 includes a plurality of internal threads 70 for accepting the external threads 66 of the post 16. When the external threads 66 and the internal threads 70 interlock or screw together, the post 16 is held securely in a vertical position extending upwardly from the base 14. When the user disassembles the stand 10 for storage or transport, the post 16 is unscrewed from the base 14 by pressing on a tab 72 on the base 14. The tab 72 releases the tapered notch 64 and allows the post 16 to unscrew from the base 14, thereby allowing the stand 10 to be disassembles for transporting and storing more easily.

In additional embodiments, a shelf may be attached to the post 16 between the upper end 30 and lower end 32 for displaying handouts, flyers, or maps. Furthermore, one of the double signs 36 and 38 may also be removed and the invention may include just one single sign 36.

In conclusion, herein is presented a portable stand for supporting a sign. The invention is illustrated by example in the drawing figures, and throughout the written description. It should be understood that numerous variations are possible, while adhering to the inventive concept. Such variations are contemplated as being a part of the present invention.

What is claimed is:

1. A portable stand for supporting at least one sign upon a ground surface, comprising:

a base, the base substantially rectangular and having a hollow inside cavity, the base having a lower surface which is for resting upon the ground surface, the base having an upper surface that includes an aperture;

a post having an upper end and a lower end, the post is hollow, the lower end for securing within the base, the post having an opening at the upper end, the post having a plug for selectively sealing the upper opening, and selectively allowing the base to be filled with a weighting substance though the upper end of the post;

at least one square block attached to the post near the upper end; and a rectangular frame attached to the square block, the rectangular frame having a backing surface that is permanently attached to the block, the frame having one vertical side which is cutout for allowing the sign to be inserted into the frames, the frame having a front window for viewing the sign.

2. The portable stand as recited in claim 1, for use with a pair of signs, wherein the at least one square block further comprises two square blocks attached to the post, and wherein the rectangular frame further comprises two rectangular frames, each rectangular frame secured to one of the square blocks.

3. The portable stand as recited in claim 2, wherein the post includes a transverse cylindrical hole that bisects the post between the upper end and lower end, the cylindrical hole has a pair of ends selectively allowing a cable lock to extend therethrough; ande further comprising a pair of caps that are selectively used to plug the ends of the cylindrical hole.

4. The portable stand as recited in claim 3, wherein the base has a side plug that may be selectively removed from the base to allow the weighting substance to be emptied from the base.

5. The portable stand as recited in claim 4, wherein the base has a pair of sides, each having a recess, and further comprises a wheel attached in each recess of the base.

6. The portable stand as recite in claim 5, further comprising a pair of stakes attached to the lower surface of the base and extending downwardly to penetrate the ground surface for holding the stand in position.

* * * * *